US005398372A

United States Patent [19]

Kush

[11] Patent Number: 5,398,372

[45] Date of Patent: Mar. 21, 1995

[54] LIQUID EDGE BEAD REMOVAL DEVICE

[75] Inventor: Donald C. Kush, Pleasanton, Calif.

[73] Assignee: Kaiser Aluminum & Chemical Corporation, Pleasanton, Calif.

[21] Appl. No.: 143,231

[22] Filed: Oct. 29, 1993

[51] Int. Cl.[6] ..... B08B 5/02

[52] U.S. Cl. ..... 15/309.1; 15/316.1

[58] Field of Search ..... 15/306.1, 307, 309.1, 15/316.1

[56] References Cited

U.S. PATENT DOCUMENTS

| | | | |
|---|---|---|---|
| 1,748,188 | 2/1930 | Phillippe | 15/309.1 X |
| 2,713,011 | 7/1955 | Durst | 15/309.1 X |
| 3,192,752 | 7/1965 | Dowd et al. | 72/45 |
| 3,518,713 | 7/1970 | Krause | 15/306.1 |
| 3,601,837 | 8/1971 | Conrad et al. | 15/316.1 X |
| 3,654,659 | 4/1972 | Blumenthal | 15/309.1 |
| 3,775,806 | 12/1973 | Olbant et al. | 15/309.1 |
| 4,202,073 | 5/1980 | Hughes | 15/309.1 |
| 4,400,961 | 8/1985 | Schaming | 72/201 |
| 4,477,287 | 10/1984 | Kush et al. | 134/15 |
| 4,601,112 | 7/1986 | Kush et al. | 34/9 |
| 4,691,549 | 9/1987 | Adair | 72/38 |
| 5,313,685 | 5/1994 | Kramer et al. | 15/309.1 |

FOREIGN PATENT DOCUMENTS 244530 10/1986 Japan .

*Primary Examiner*—Christopher K. Moore

*Attorney, Agent, or Firm*—Andrew E. Barlay; Gerald D. Haynes

[57] ABSTRACT

A device and a method are provided for the removal of liquid coolant or lubricant edge beads from the side marginal edges of a moving web, such as metal sheet or strip. The device consists of two or more pairs of manifolds, wherein the individual manifolds of each pair are positioned above and below the main surfaces of the moving web and the manifolds also extend beyond the side edges of the web. The manifolds are arranged at an angle to the side marginal edges of the web and compressed gas is introduced to the manifolds. The introduction of the compressed gas, such as air, through the manifolds provides vertical curtains of compressed gas parts of which impinge on the surfaces of the web and thus create turbulence at the side marginal edge portions where the liquid edge bead is located. Due to the turbulence created at the side marginal edge areas of the moving web effective removal of the liquid edge bead can be accomplished.

7 Claims, 1 Drawing Sheet

FIG._1
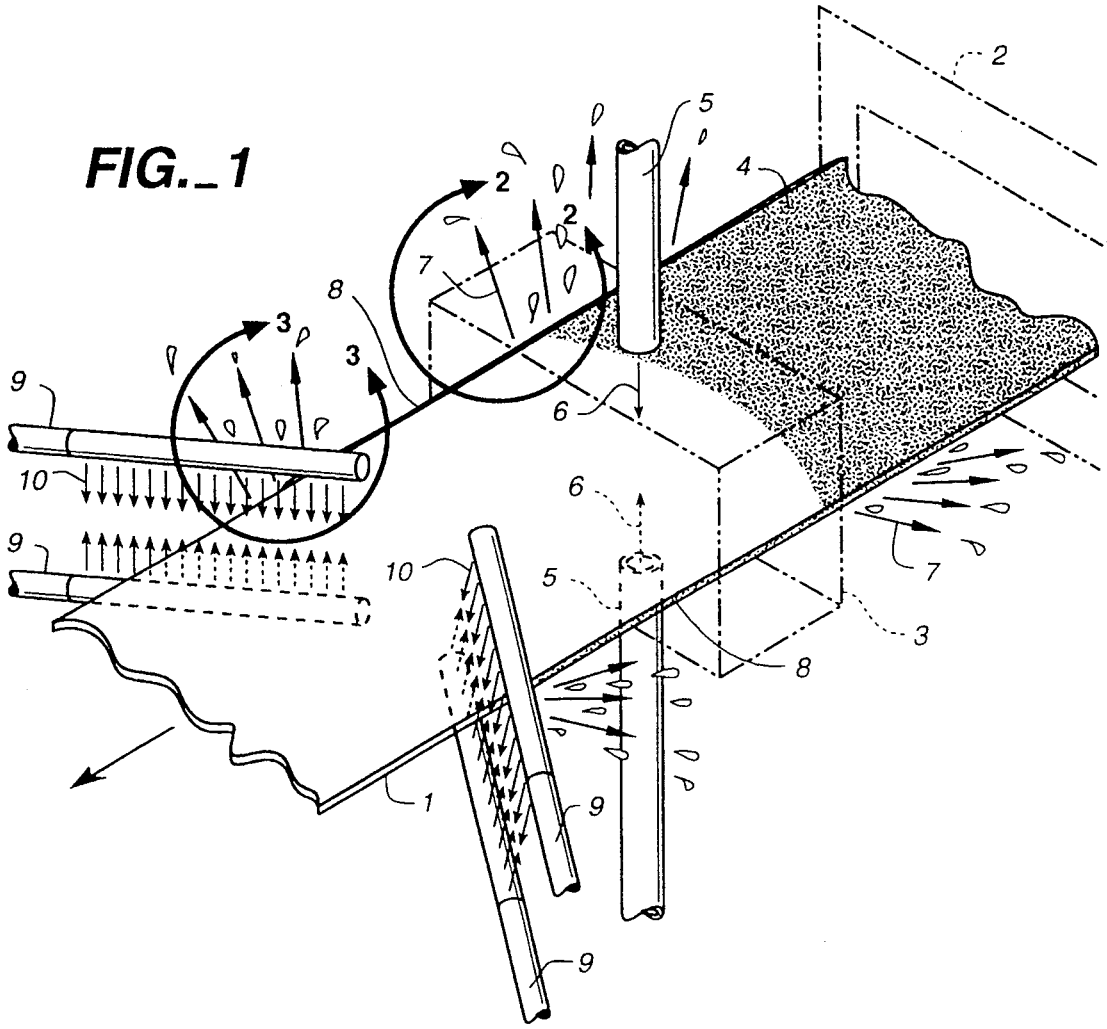
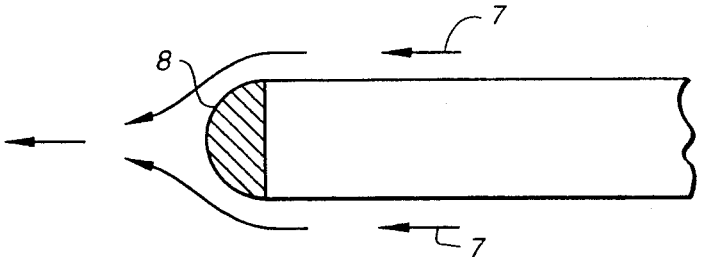
FIG._2
(PRIOR ART)
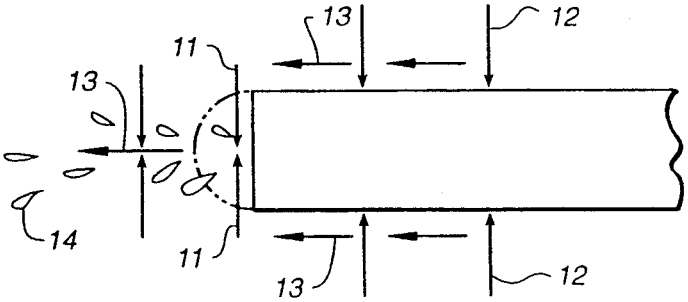
FIG._3

LIQUID EDGE BEAD REMOVAL DEVICE

BACKGROUND OF THE INVENTION

This invention relates to the removal of liquid residues from the surfaces of a moving strip or sheet. More particularly, this invention relates to a device and a method for the removal of adhered liquid residues, such as coolant and/or lubricant residues, from the side marginal edges of a continuously moving metal strip or sheet, for example aluminum strip or sheet.

When liquid residues remain on the surfaces of metal strips and/or sheet products, these liquid residues can detrimentally affect the surface properties of the strip and/or sheet. For example, moisture remaining on the surfaces can stain and ultimately oxidize the surfaces, while lubricant residues, particularly water-based lubricant residues, can cause discoloration, oxidation and other undesired effects when for example the strip is coiled or the sheet product is stacked. Apart from the undesired appearance, liquid residues can affect the physical properties of the products. These detrimental effects were long recognized and there are several systems described in the prior art which were developed for the removal of residual liquids from moving surfaces. Most of these systems remove the residual liquids from the main surfaces of strips or sheet products, i.e. the top and bottom surfaces of these. Representative prior art liquid removal systems designed to remove residual liquids from moving strip and sheet surfaces are disclosed in the following U.S. Pat. Nos.: 3,192,752 (Dowd et al), 4,477,287 (Kush et al) and 4,691,549 (Adair).

While removal of the residual liquid from the top and bottom surfaces of moving strips and sheet products is very important, no lesser importance is attached to the removal of liquid residue or edge bead from the side marginal edges of moving strips and sheets. If the liquid edge bead remains on the side marginal edges of strip and sheet products, it is transferred to the top and bottom surfaces by deflector rolls and by capillary flow after stacking or coiling. The removal of the liquid edge bead is of equal importance to the removal of residual liquid from top and bottom surfaces in preserving the quality of the rolled products.

Some prior art systems were designed to attempt to remove the residual liquid from both the top and bottom surfaces of strips and sheets and also the liquid edge bead on the side marginal surface. The combination of these two functions is shown for example in U.S. Pat. No. 4,400,961 where air is used to blow liquid residues off from both the upper and lower surfaces of a moving strip and also from the longitudinal edges of the strip. The pattern of air jets directed to the surfaces of the strip and towards the edges is claimed to dislodge coolant remaining on these surfaces and aspirators energized to pull atomized coolant from the regions immediately above and below the strip for the elimination of residual coolant. Use of the device shown in the aforementioned patent, while suitable for the removal of coolant residues from the top and bottom surfaces of a moving strip, was found to lack the required efficiency for the elimination of the liquid edge bead from the side marginal edges of the strip. In addition, the space requirements for the above-described coolant removal device in the vicinity of the rolls of the rolling mill make the utilization of this device difficult. A special system, directed to the removal of liquid edge bead, is provided in U.S. Pat. No. 4,601,112 (Kush et al). This patent describes a method and a device wherein liquid edge bead is removed from rapidly moving strip and sheet edges by wiping of the edges with rollers and the application of vacuum in the vicinity of the rollers. While the device shown in the aforementioned patent allows effective removal of the liquid edge bead from side marginal edges of a continuously moving strip, it is a contacting, mechanical device that is easily damaged by strip breaks or other operational mishaps and it also requires substantial space for positioning the edge bead removal rollers and the vacuum means downstream from the rolling mill. This large space requirement may interfere with equipment positioned after the last roll of the rolling mill, for example, with the coiling apparatus generally employed for strips. Another reference, Japanese Publication 61-244530 to Sumitomo Chemical Industries KK (published on Oct. 30, 1986) discloses the removal of water from the surfaces and edges of a metal sheet-plastic film composites by blowing the water off with an air spray applied to the top and bottom surfaces of the composite through nozzles. The angles of the air nozzles are set at 15°–60° against the direction of movement of the composite as it exits the rolls and the air is blown towards the edge portions of the composite. Through the use of the angled air nozzles water is claimed to be removed from both the top and bottom surfaces of the composite and also from the edges. The arrangement of the air jets utilized in the aforementioned Japanese reference provides angular velocity factors incapable of creating turbulence at the edge region of the composite and consequently the device disclosed in the Japanese reference does not allow substantial and effective removal of all of the liquid edge bead. This is particularly true at high rolling speeds, which are generally utilized in the rolling of metal strips and sheet, for example at speeds from about 500 to about 6000 feet/minute (153–1830 meters/minute) even the removal of water from the top and bottom surfaces will be less than satisfactory.

It is the purpose of this invention to provide an edge bead removal method and device which at the rates of speed generally utilized in the rolling of metal strips and sheet, particularly aluminum strip and sheet, substantially and effectively remove liquid edge bead adhering to the side marginal surfaces of the strips and sheet. This is accomplished by using, instead of the conventional air jets, vertical air curtains so that the velocity factor in the edge region of the moving strip or sheet is essentially parallel to the plane of the edge surface. The term "air", as used hereinafter, encompasses air, nitrogen and inert gases. The turbulence created in the edge region allows substantial and effective removal of the liquid edge bead both at conventional and at high rolling speeds.

BRIEF DISCUSSION OF THE DRAWINGS

FIG. 1 is an isometric view of the edge bead removal device of the invention positioned above and below the surfaces of a moving strip as such strip exits from a rolling mill and prior to being coiled or stacked;

FIG. 2 graphically shows, in a conventional system, the direction of travel of a portion of the air streams which impinge on the surfaces of a moving belt and which are deflected towards the edges of the strip without disturbing the liquid edge bead; and FIG. 3 graphically shows the effect of the application of the novel edge bead removal device to a moving strip wherein the collisions of the gas streams at the edge portion cause turbulence resulting in the removal of the liquid edge bead.

DETAILED DESCRIPTION OF THE INVENTION

Although the application of the novel liquid edge bead removal device will be discussed with particular reference to the removal of liquid edge bead from aluminum strip or sheet, it is to be understood that the invention can also find application in other industries where the existence of liquid edge bead causes similar problems.

With reference to FIG. 1, it can be seen that the web or strip 1 exits from a quench or similar device where a liquid is applied to the surface of the web or strip, for example coolant or a water-based lubricant. The web or strip 1 then passes through a containment device 3 which prevents the passage of liquid 4 on the top and bottom surfaces of the web or strip. The containment system can be of any conventional design, for example the type described in U.S. Pat. No. 4,477,287. These containment systems typically incorporate nozzles 5 that discharge a high velocity gaseous medium, for example air or an inert gas 6, generally both to the top and bottom surfaces of the web.

In the conventional systems, the high velocity gas removes the residual liquid from the surfaces of the moving web and also diverts any airborne liquid so that it is not able to remain on the surface and cause contamination.

Application of the high velocity gas to the surfaces of the moving web deflects at least a portion of the gas towards the edges of the moving belt. The path of the deflected gas stream 7 is shown in FIG. 2 and it can be observed that the velocity vectors of the deflected gas stream 7 in conventional systems merge past liquid edge bead 8 and thus liquid edge bead 8 remains undisturbed on the side edges of the web. The presence of such residual liquid edge bead is Generally the cause of several problems, for example corrosion and/or discoloration.

To overcome the disadvantages presented by the prior art systems the present invention employs a liquid edge bead removal device which consists of two or more pairs of manifolds 9. In each pair of manifolds, the individual manifolds are positioned in parallel arrangement above and below the surface of the moving web or strip 1, each of the manifolds being equidistant from the surface (top and bottom) of the moving web 1 and in an exactly opposing relationship. Each pair of manifolds is arranged parallel to the plane of the web and positioned at an angle to the side edge of the moving web. It has been found that satisfactory results can be obtained in terms of liquid edge bead removal when the angle of the manifolds, relative to the side edges of the web, are within the range of 10° and 80° . Optimum liquid edge bead removal results can be achieved when the angle of the manifolds relative to the side edges of the moving belt are maintained between 40° and 50°.

Each manifold 9 is has a series of perforations or slots along its entire length to allow the formation of a gas curtain 10 when gas is introduced under pressure, for example at about 50–90 psi (3.4–6.1 atm), into the manifold. The gas curtains 10 generated from each manifold 9 are approximately normal to the plain of web 1. Manifolds 9 are so positioned above and below the surface of the moving web that they do not interfere with the movement of the web, but at the same time provide an effective gas curtain 10 capable of removing the liquid edge bead from the side edges of the moving web. It has been found that good results can be readily achieved in terms of liquid edge bead removal when two pairs of manifolds are utilized and the following parameters are observed: the distances of the individual manifolds 9 from the top and also from the bottom surface of moving web 1 are kept about 1 to 2 inches (2.54–5.08 cm); the pressure of the compressed Gas is maintained at about 70 psi (4.7 atm.); and the rate of speed at which the web moves is about 800 feet per minute (244 m/minute). The optimum distance between manifold 9 and web 1 is generally established by taking into account the rate of speed at which the web moves, the type of liquid that forms the edge bead and the pressure of the compressed gas which forms the gas curtain. The optimum conditions for any given situation can be readily established experimentally.

In order to achieve the successful removal of the liquid edge bead 8 from the web, the individual manifolds 9, as shown in FIG. 1, extend beyond the side edge of the moving web. If the distance between the manifold and the surface of the belt is kept at about 1¼ inches (3.18 cm), then length of the Gas curtain 10 should provide at least about 3 inches (7.62 cm) of impingement on the web and also about the same length of gas curtain 10 beyond the side edge of the web. Generally, however, it is not necessary that the length of the manifold extending beyond the side edges of the web be the same as the length of the manifold over the top or bottom surface of the web. FIG. 3 shows that the collision of fractional gas curtain 11 at the side edge of web 1 causes extreme turbulence against the side edge of the web which disturbs and removes liquid edge bead 8 from the side edge of the web. The fractions 12 of gas curtains 10 that impinge on the top and bottom surfaces of web 1 are deflected in a manner indicated by arrows 13 so that the airborne liquid edge bead 14 is directed away from web 1 resulting in essentially complete liquid edge bead removal.

Tests were also conducted to study the effectiveness of the instant liquid edge bead removal device in comparison to the systems described in U.S. Pat. No. 4,400,961 and Japanese Publication 61-244530. In testing the liquid edge bead removal device of the instant invention, the angle of the manifolds to the side edge of the web was maintained at 45°, the manifolds were at a distance of 1.25 inches (3.18 cm) above the respective surfaces of the web, the web was advanced at the rate of 800 feet/minute (244 m/min) and the pressure of the gas introduced through the manifolds was 70 psi (4.8 atm.). Without the application of the novel device, the liquid edge bead volume, which was established by scraping it off from the side edge, was 34.8 ml/min. When the novel device was applied under the same operational parameters, the residual liquid edge bead volume was reduced to 2 ml/min. The comparison test with the device described in U.S. Pat. No. 4,400,961 yielded a residual liquid edge bead volume of 7 ml/min, while the device disclosed in Japanese Publication 61-244530 yielded a residual liquid edge bead volume of 8 ml/min.

Thus it can be readily observed that the instant liquid edge bead removal device provides superior results in comparison to the prior art systems and its application results in the production of metal strips and sheets of improved quality. This quality improvement is of particular importance in can body sheet production where excellent surface properties are demanded.

The novel liquid edge bead removal device is equally efficient when applied to rolling mills operating at speeds in excess of 3000 feet/min (915 m/min). At these higher rates of speed, under certain circumstances, it may be necessary to employ more than two pairs of manifolds arranged in successive order to achieve the same high degree of liquid edge bead removal provided by the novel device at lower rates of speeds.

The present liquid edge bead removal device described above lends itself to many obvious variations and modifications. Thus, for example, instead of using two pairs of manifolds across the width of the web, multiple manifold pairs can be applied. Also, adjacent to the side edges of the moving belt airborne liquid edge bead collection means, such as vacuum can be utilized, which can capture and remove airborne coolants or lubricants. It is also possible to employ only one pair of manifolds over the surfaces of the moving web, particularly when the web from which the liquid edge bead is to be removed has a relatively narrow width, for example about 15 inches (38.1 cm). In such instances, the top and bottom manifolds extend across the entire width of the web and these manifolds should also extend beyond the side edges of the web. The angle of the manifolds relative to the side edges of the moving web should be maintained in the range from about 10° to about 80°, preferably within 40° and 50°. A suitable arrangement for the manifolds positioned across the width of a narrow web is a chevron or V arrangement with the point of the V aiming against the direction of travel of the web.

What is claimed is:

1. A device for the removal of liquid edge bead from the side marginal edges of moving webs, the edge bead removal device comprising at least two pairs of manifolds, one pair of manifolds being arranged at the side of moving web and the other pair of manifolds being arranged in opposing relationship thereto on the other side across the moving web, each pair of manifolds consisting of a top manifold positioned above a top surface of the moving web and extending beyond a corresponding side marginal edge of the web and a bottom manifold positioned below a bottom surface of the moving web and extending beyond the corresponding side marginal edge of the web, the top and bottom manifolds in each pair being adapted to discharge a compressed gas stream or curtain onto respective top and bottom surfaces of the moving web, the top and bottom manifolds in each pair being arranged in a substantially parallel relationship and also substantially equidistant from respective top and bottom surfaces of the moving web, each pair of manifolds being positioned parallel to a plane passing through the moving web and extending beyond corresponding side marginal edges of the moving web, each pair of manifolds being located at such an angle relative to its corresponding side marginal edge of the moving web that when the compressed gas streams from the manifolds impinge on the top and bottom surfaces of the moving web at least a portion of the gas streams is deflected towards the side edges of the web and the deflected portion of the gas streams in combination with the gas streams produced from those sections of the manifolds which extend beyond the side marginal edges of the web, collide with and substantially remove the liquid edge bead from the side marginal edges of the moving web.

2. A device according to claim 1 wherein the angle of the manifolds relative to the side marginal edges of the moving web is within the range from about 10° to about 80°.

3. A device according to claim 1 wherein the angle of the manifolds relative to the side marginal edges of the moving web is within the range from about 40° to about 50°.

4. A device according to claim 1 wherein the compressed gas stream discharged from said manifolds acts on a moving web of metal.

5. A device according to claim 1 wherein the compressed gas stream discharged from said manifolds acts on a moving web of aluminum sheet or strip.

6. A device according to claim 1 wherein the compressed gas is selected from air, nitrogen and inert gases.

7. A device according to claim 1 wherein the compressed gas is air.

* * * * *